US009518726B2

(12) United States Patent
Wang et al.

(10) Patent No.: US 9,518,726 B2
(45) Date of Patent: Dec. 13, 2016

(54) LED MODULE

(71) Applicant: Lina Wang, Puijiang, Zhenjiang (CN)

(72) Inventors: Lina Wang, Zhenjiang (CN); Yuancheng Wang, Zhenjiang (CN)

(73) Assignee: Lina Wang, Pujiang, Zhenjiang (CN)

( * ) Notice: Subject to any disclaimer, the term of this patent is extended or adjusted under 35 U.S.C. 154(b) by 0 days.

(21) Appl. No.: 14/760,459

(22) PCT Filed: Oct. 8, 2014

(86) PCT No.: PCT/CN2014/000893

§ 371 (c)(1),
(2) Date: Jul. 10, 2015

(87) PCT Pub. No.: WO2015/074323

PCT Pub. Date: May 28, 2015

(65) Prior Publication Data

US 2016/0258613 A1 Sep. 8, 2016

(30) Foreign Application Priority Data

Nov. 21, 2013 (CN) ..... 2013 1 0594113

(51) Int. Cl.
*F21V 29/00* (2015.01)
*F21V 29/76* (2015.01)
(Continued)

(52) U.S. Cl.
CPC ..... *F21V 29/763* (2015.01); *F21K 9/30* (2013.01); *F21V 5/007* (2013.01); *F21V 23/005* (2013.01); *F21V 31/005* (2013.01)

(58) Field of Classification Search
CPC .... F21V 29/763; F21V 31/005; F21V 23/005; F21V 5/007; F21K 9/30
See application file for complete search history.

(56) References Cited

U.S. PATENT DOCUMENTS

2007/0133203 A1* 6/2007 Chen ..... F21V 5/04 362/235
2008/0143259 A1* 6/2008 Sibout ..... B60Q 3/0253 315/78
2011/0317420 A1 12/2011 Jeon et al.

FOREIGN PATENT DOCUMENTS

CN 202532251 U 11/2012
CN 202660505 U 1/2013
(Continued)

*Primary Examiner* — Thomas M Sember

(74) *Attorney, Agent, or Firm* — Global IP Services; Tianhua Gu

(57) ABSTRACT

An LED module includes an LED, a printed circuit board (PCB), a lens, a lens mask and a heat dissipation component; the heat dissipation component includes an aluminum-made heat dissipation frame, a heat-conducting fin, a connection assembly part and a plurality of heat dissipation plates, the aluminum-made heat dissipation frame is provided with a plurality of heat dissipation plate mounting holes that are arranged in parallel, the heat dissipation plates are amounted in the heat dissipation plate mounting holes on the aluminum-made heat dissipation frame in an insertion mode, the PCB is fixed on a bottom surface of the aluminum-made heat dissipation frame, and the heat-conducting fin is located between the PCB and the heat dissipation plates on the aluminum-made heat dissipation frame; and the aluminum-made heat dissipation frame is provide with a wire-threading position, and a location of the wire-threading position is between a corresponding electrical interface and a corresponding power-on interface.

8 Claims, 4 Drawing Sheets

(51) Int. Cl.

| | |
|---|---|
| ***F21K 99/00*** | (2016.01) |
| ***F21V 31/00*** | (2006.01) |
| ***F21V 23/00*** | (2015.01) |
| ***F21V 5/00*** | (2015.01) |

(56) References Cited

FOREIGN PATENT DOCUMENTS

| | | | |
|---|---|---|---|
| CN | 102954410 | A | 3/2013 |
| CN | 103032854 | | 4/2013 |
| CN | 203231280 | U | 10/2013 |
| CN | 103604055 | A | 2/2014 |
| CN | 203671300 | U | 6/2014 |

* cited by examiner

LED MODULE

CROSS REFERENCE TO RELATED PATENT APPLICATION

The present application is the US national stage of PCT/CN2014/000893 filed on Oct. 8, 2014, which claims the priority of the Chinese patent applications No. 201310594113.4 filed on Nov. 21, 2013, which applications are incorporated herein by reference.

FIELD OF THE INVENTION

The present invention relates to the field of light emitting diode (LED) lighting lamps.

BACKGROUND OF THE INVENTION

LED lighting lamps have been widely used because the LED lighting lamps have advantages of energy saving and environmental protection. An LED module is the most important component part in an LED lamp. The biggest limitation for an existing LED module is that the LED module cannot be changed. Once a product is formed, the size of shape and power of the product cannot be adjusted, and brightness can only be adjusted by using a brightness adjusting module built in a circuit, that is, the brightness cannot be increased in a large degree, and the brightness increasing can only be implemented by increasing the number of LED lighting lamps. Multiple LED lighting lamps are separated but not connected, or are electrically connected by together by using an exposed wire, and cannot be used as an integral whole. In addition, low-voltage LEDs are used mostly in the LED market. With the maturing of an alternating current LED technology and a direct current high-voltage LED technology, the alternating current LED technology and the direct current high-voltage LED technology will be used widely. Different types of LEDs have different drive voltage modes and different LED arrangement manners. If for each type of LED, a different printed circuit board (PCB) and a different lens cover are made, it is not only troublesome, but also causes waste of materials and equipment.

SUMMARY OF THE INVENTION

An objective of the present invention is to solve the limitation existing in the foregoing existing LED module, and to provide an LED module having a novel structure and good heat dissipation performance, and being suitable for outdoor use, where the heat dissipation performance may be adjusted freely.

To achieve the foregoing invention objective, the present invention uses the following technical solutions:

An LED module includes an LED, a PCB, a lens, a lens mask and a heat dissipation component, where the LED is mounted on the PCB, the PCB is fixed on the heat dissipation component, the lens is mounted on the lens mask in an enclosed manner, the lens mask is fixed on the heat dissipation component, and a sealed waterproof ring is disposed between the lens mask and the heat dissipation component; the heat dissipation component includes an aluminium-made heat dissipation frame, a heat-conducting fin, a connection assembly part and a plurality of heat dissipation plates, the aluminium-made heat dissipation frame is provided with a plurality of heat dissipation plate mounting holes that are arranged in parallel, the heat dissipation plates are amounted in the heat dissipation plate mounting holes on the aluminium-made heat dissipation frame in an insertion mode, the PCB is fixed on a bottom surface of the aluminium-made heat dissipation frame, and the heat-conducting fin is located between the PCB and the heat dissipation plates on the aluminium-made heat dissipation frame; the connection assembly part is fixed at an edge of an upper part of the aluminium-made heat dissipation frame, each connection assembly part is provided with an electrical interface on which ingress protection (IP) treatment has been performed, the PCB is provided with a power-on interface that matches to the electrical interface on the connection assembly part and can connect to the electrical interface, a wire-threading position is provided on the aluminium-made heat dissipation frame, and a location of the wire-threading position is between a corresponding electrical interface and a corresponding power-on interface; and there is a plurality of connection assembly parts, the number of wire-threading positions and power-on interfaces matches to the number of connection assembly parts, at least one wire-threading position is a wire-threading through-hole, the rest wire-threading positions are wire-threading clamping grooves that can be penetrated through impact.

Preferably, a section of the aluminium-made heat dissipation frame is rectangular, an edge of each side of the upper part of the aluminium-made heat dissipation frame is provided with a connection assembly part, there are 4 connection assembly parts, a location of each connection assembly part is at a middle position of each side, and the connection assembly parts are integrally connected to the aluminium-made heat dissipation frame; and the aluminium-made heat dissipation frame is provided with 4 wire-threading positions, the PCB is provided with 4 power-on interfaces, whose locations match to the electrical interfaces on the connection assembly parts, that can connect to the electrical interfaces. Due to the connection assembly part on the aluminium-made heat dissipation frame and the power-on interface on the PCB, extension edges are retained around the LED module, and combination change of different usages and different power grades is implemented, so as to facilitate multi-purpose requirements of consumers, that is, multiple LED modules may be conveniently jointed and combined, and the connection assembly part not at a joint position may be used for installation and fixing of the LED module.

Preferably, a section of the aluminium-made heat dissipation frame is square, combination of multiple modules achieves a best effect, and the combination may be performed freely at four directions.

Preferably, the PCB is provided with an LED brightness adjusting module, the PCB is provided with 4 power-on interfaces, and each power-on interface can control an LED switch and adjust LED brightness, switches and brightness of all LEDs on the PCB may be controlled by switching on any power-on interface on one PCB, which is convenient for use; the LED is integrally connected to the PCB, so as to reduce power supply requirements and reduce the volume of units, which effectively reduces requirements for power supply performance and reduces space of the volume; an integrated circuit (IC) chip on the PCB controls a working current and a quantity of working heat of the LED through pulse width modulation, and performs regulated voltage and constant current adjustment by changing a duty cycle, a current is reduced automatically to ensure stability of working performance of the LED when an interior temperature exceeds a set index, and stable voltage is implemented by changing the duty cycle, so that voltage fluctuation is effectively reduced and a constant current drive effect of the LED is improved; and a shape of the lens mask is a rectangle that matches to the bottom surface of the aluminium-made heat dissipation frame, a middle part of the lens mask protrudes downward relative to an edge of the lens mask to form a cavity, the edge of the lens mask is fixed at an edge of a bottom part of a rectangular fixing panel by using a screw, and the lens mask is securely mounted.

Preferably, all edges of 4 broadsides of the lens mask are regularly provided with airflow notches; an edge of a bottom part of the lens mask is provided with a plurality of mounting bases that are arranged regularly and protrude downward, the mounting bases are integrally connected to the lens mask, and the screw passes through the mounting base to be fixed on the aluminium-made heat dissipation frame; a groove for holding the sealed waterproof ring is provided at a joint on the lens mask between the aluminium-made heat dissipation frame, the sealed waterproof ring is fastened in the groove, and a location of the sealed waterproof ring is at an inner side of the screw, which improves an (ingress protection) IP degree; the lens mask is provided with 12 lens mounting holes, 12 lens are mounted on the lens mounting holes in an enclosed and pressing manner, the 12 lens are arranged into 4 arc-shaped lens strips of a same length, and each arc-shaped lens strip is formed by arrangement of 5 lens; and the number and arrangement locations of LEDs on the PCB match to the lens, that is, an LED is provided right above each lens, and 12 LEDs are arranged into 4 arc-shaped LED lighting strips of a same length, which have a good lighting effect and are convenient for replacement of a subsequent LED of different voltage; further, the number, shape and location of airflow notches of 4 broadsides are the same, an edge of each broadside is provided with at least 2 airflow notches, and when two LED modules are jointed, two airflow notches of corresponding locations and shapes are connected to form convection space; and connecting holes are separately provided at two sides of the electrical interface on the connection assembly part, a mounting connecting plate is provided on the connection assembly part, and a bolt passes through the mounting connecting plate to be fixed in the connecting hole, as so to facilitate installation and fixing of the whole LED module.

Preferably, an upper surface of the aluminium-made heat dissipation frame is provided with two fixed heat dissipation plates, and bottom parts of the two fixed heat dissipation plates are integrally connected to the upper surface of the aluminium-made heat dissipation frame; and a section of the heat dissipation plate is of an L shape, the heat dissipation plate is integrally formed by a long plate and a short plate, the long plate passes through the heat dissipation plate mounting hole on the aluminium-made heat dissipation frame, the short plate is fastened on the aluminium-made heat dissipation frame below the heat dissipation plate mounting hole, and combination of the aluminium-made heat dissipation frame is convenient.

Preferably, an electrical connector is disposed in at least one electrical interface right above the wire-threading through-hole, which is convenient for use.

By using an LED module of the foregoing technical solutions, a lens is mounted on a lens mask in an enclosed manner, a sealed waterproof ring is disposed between the lens mask and a heat dissipation component, each connection assembly part is provided with an electrical interface on which IP treatment has been performed, so that good IP performance is achieved, and an IP degree reaches at least 66, which is suitable for outdoor use. The heat dissipation component includes an aluminium-made heat dissipation frame, a heat-conducting fin, a connection assembly part and a plurality of heat dissipation plates, and the heat-conducting fin is located between a PCB and the heat dissipation plates on the aluminium-made heat dissipation frame, so that heat dissipation performance and heat conduction performance are both good, and in addition to heat conduction, the heat-conducting fin is also used for location fixing of the heat dissipation plates. The heat dissipation plates are amounted in heat dissipation plate mounting holes on the aluminium-made heat dissipation frame in an insertion mode, and the number of the heat dissipation plates may be selected freely, that is, heat dissipation performance may be adjusted freely. Due to the connection assembly part and a power-on interface on the PCB, extension edges are retained on the LED module, and combination change of different usages and different power grades is implemented, so as to facilitate multi-purpose requirements of consumers, that is, multiple LED modules may be conveniently jointed and combined, and the connection assembly part not at a joint position may be used for installation and fixing of the LED module. In conclusion, the LED module has the advantages of having a novel structure, good heat dissipation performance and good waterproof performance, and being suitable for outdoor use, where the heat dissipation performance may be adjusted according to needs by selecting the number of heat dissipation plates, and the modules may be combined freely.

DETAILED DESCRIPTION OF THE INVENTION

Figure 1:
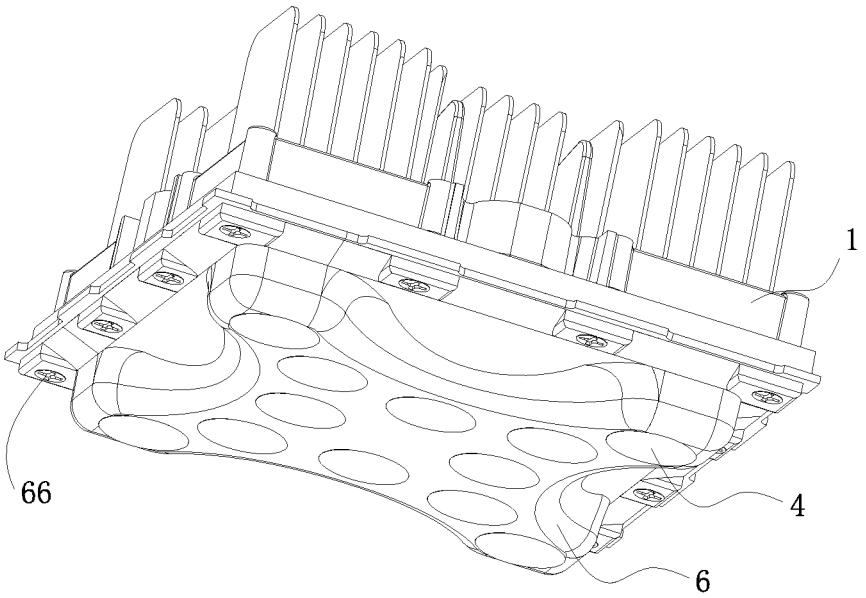
FIG. 1 is a schematic three-dimensional diagram according to an embodiment of the present invention.
Figure 7:
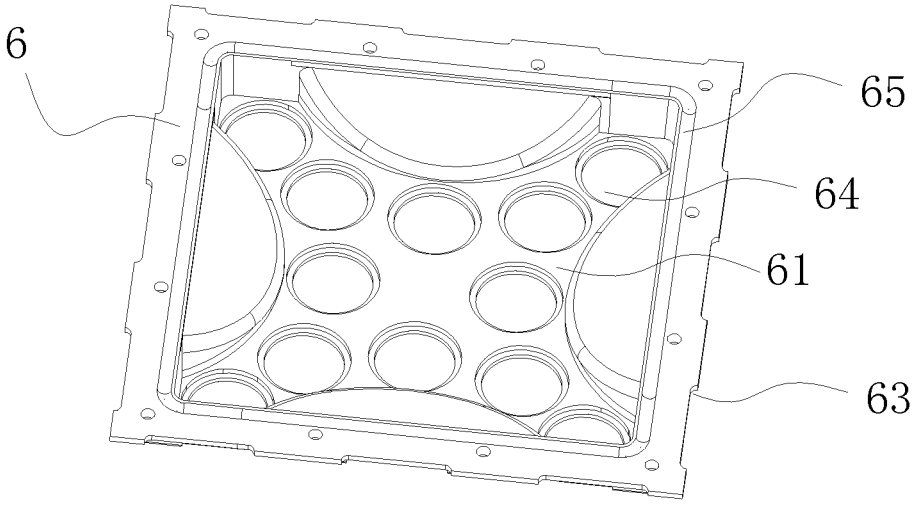
FIG. 7 is a schematic diagram 2 of a lens mask according to an embodiment of the present invention.
Figure 2:
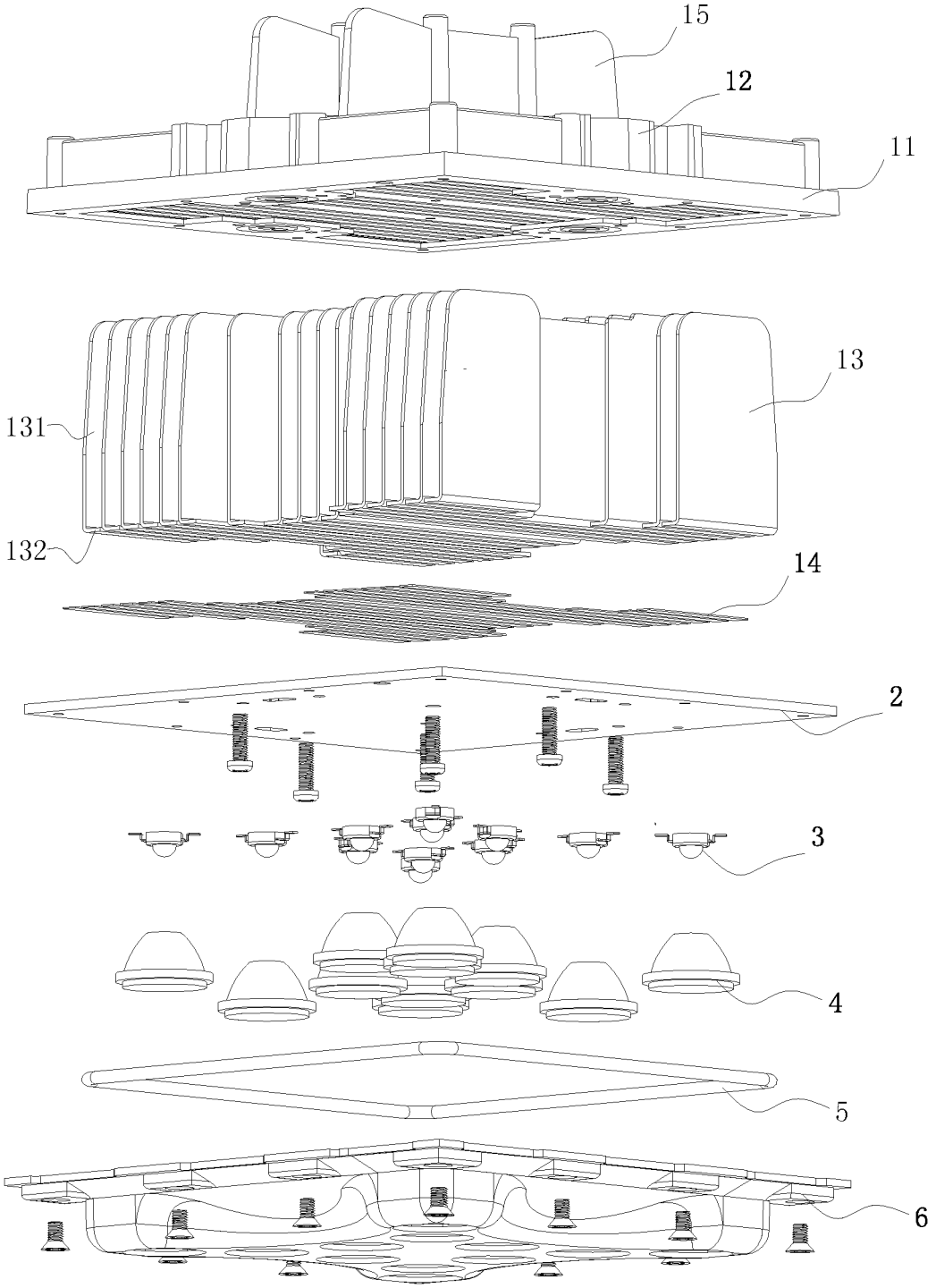
FIG. 2 is a schematic exploded diagram according to an embodiment of the present invention.
Figure 3:
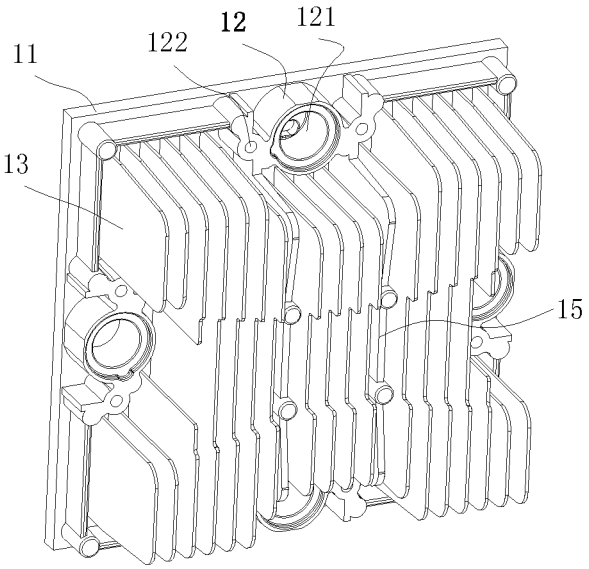
FIG. 3 is a schematic diagram of a heat dissipation component according to an embodiment of the present invention.
Figure 4:
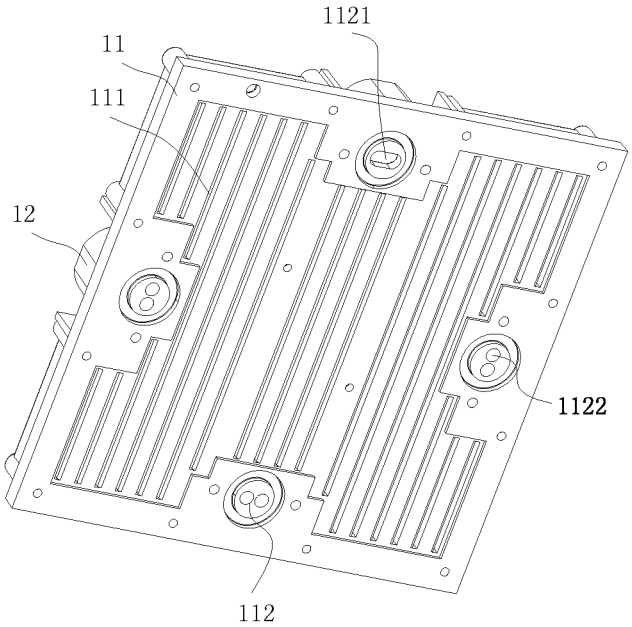
FIG. 4 is a schematic diagram of an aluminium-made heat dissipation frame and a connection assembly part on the aluminium-made heat dissipation frame according to an embodiment of the present invention.
Figure 5:
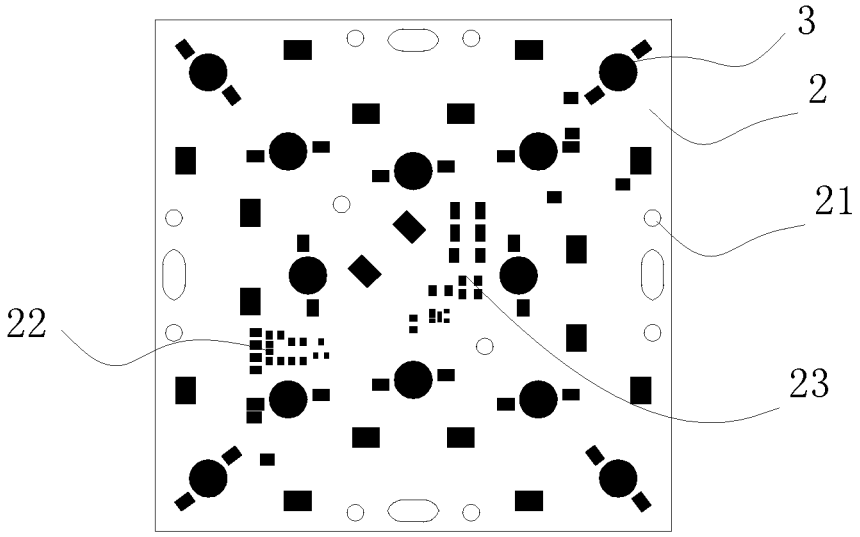
FIG. 5 is a schematic assembly diagram of a PCB and an LED according to an embodiment of the present invention.
Figure 6:
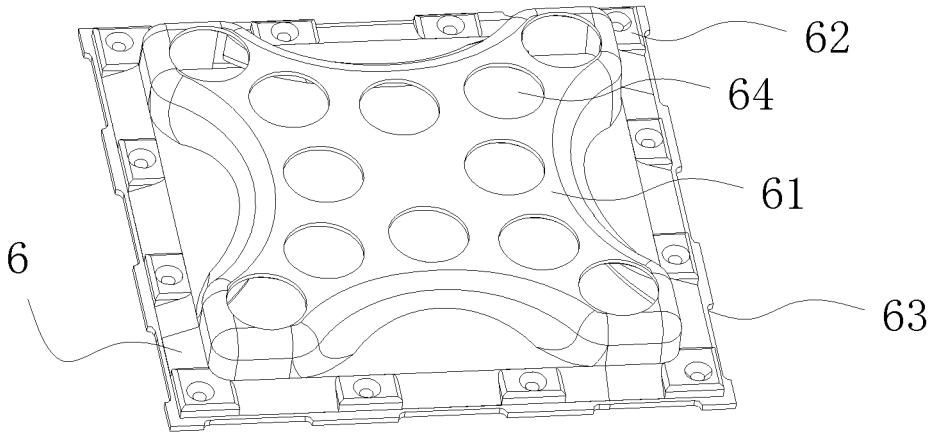
FIG. 6 is a schematic diagram 1 of a lens mask according to an embodiment of the present invention.

Specific implementation manners of the present invention are described in detail below with reference to FIG. 1 to FIG. 7.

An LED module shown in FIG. 1 to FIG. 7 mainly includes an LED 3, a PCB 2, a lens 4, a lens mask 6 and a heat dissipation component 1.

The LED 3 is mounted on the PCB 2. Specifically, a bottom part of the LED 3 is integrally connected onto the PCB 2, so as to reduce power supply requirements and reduce the volume of units, which effectively reduces requirements for power supply performance and reduces space of the volume. An IC chip 22 on the PCB 2 controls a working current and a quantity of working heat of the LED through pulse width modulation, and performs regulated voltage and constant current adjustment by changing a duty cycle.

A heat dissipation component 1 mainly includes an aluminium-made heat dissipation frame 11, a heat-conducting fin 14, four connection assembly parts 12 and a plurality of heat dissipation plates 13. The aluminium-made heat dissipation frame 11 is provided with a plurality of heat dissipation plate mounting holes 111 that are arranged in parallel, and the heat dissipation plates 13 are amounted in the heat dissipation plate mounting holes 111 on the aluminium-made heat dissipation frame 11 in an insertion mode. Specifically, an upper surface of the aluminium-made heat dissipation frame 11 is provided with two fixed heat dissipation plates 15, and bottom parts of the two fixed heat dissipation plates 15 are integrally connected to the upper surface of the aluminium-made heat dissipation frame 11, the two fixed heat dissipation plates 15 are arranged symmetrically along a centre of the upper surface of the aluminium-made heat dissipation frame 11, and the fixed heat dissipation plate 15 can be used for heat dissipation, and can also be used for installation and fixing of the whole LED module; and a section of the heat dissipation plate is of an L shape, the heat dissipation plate 13 is integrally formed by a long plate 131 and a short plate 132, the long plate 131 passes through the heat dissipation plate mounting hole 111 on the aluminium-made heat dissipation frame 11, and the short plate 132 is fastened on the aluminium-made heat dissipation frame 11 below the heat dissipation plate mounting hole 111. The PCB 2 is fixed on a bottom surface of the aluminium-made heat dissipation frame 11, and the heat-conducting fin 14 is located between the PCB 2 and the heat dissipation plates 13 on the aluminium-made heat dissipation frame 11, and in addition to heat conduction, the heat-conducting fin 14 is also used for location fixing of the heat dissipation plates 13, that is, the heat-conducting fin 14 presses on the short plate 132 to fix locations of the heat dissipation plates 13. A user may select freely the number of the heat dissipation plates 13 to adjust performance of heat dissipation freely.

A section of the aluminium-made heat dissipation frame 11 is square, an edge of each side of the upper part of the aluminium-made heat dissipation frame 11 is provided with a connection assembly part 12, there are four connection assembly parts 12, a location of each connection assembly part 12 is at a middle position of each side, and the connection assembly parts 12 are integrally connected to the aluminium-made heat dissipation frame 11.

Each connection assembly part 12 is provided with an electrical interface 121 on which IP treatment has been performed, the PCB 2 is provided with 4 power-on interfaces 21 whose locations match and correspond to the electrical interfaces 121 on the connection assembly parts 12, the aluminium-made heat dissipation frame 11 is provided with four wire-threading positions. The PCB 2 is provided with an LED brightness adjusting module 23, the PCB 2 is provided with four power-on interfaces 21, and each power-on interface can control an LED switch and adjust LED brightness, that is, switches and brightness of all LEDs 3 on the PCB 2 may be controlled by switching on any power-on interface 21 on one PCB 2, which is convenient for use.

The aluminium-made heat dissipation frame 11 is provided with four wire-threading positions, and a location of the wire-threading position is between the electrical interface 121 and the power-on interface 21. At least one wire-threading position in the four wire-threading positions is a wire-threading through-hole 1121, an electrical connector on which IP treatment has been performed is disposed in at least one electrical interface 121 right above the wire-threading through-hole 1121, the electrical interface 121 is circular, the electrical connector is cylindrical, the electrical connector is located inside the circular electrical interface, which is very convenient for disassembly, assembly and use, the electrical connector is connected to the power-on interface 21 right blow the electrical connector by using a wire passing through the wire-threading through-hole 1121, and IP treatment of the electrical connector is adding a sealed waterproof washer in the electrical interface 121. The rest wire-threading positions are wire-threading clamping grooves 1122 that can be penetrated through impact. When two LED modules are jointed, the connection assembly part 12 at the wire-threading through-hole 1121 may be used for jointing, the rest connection assembly parts 12 are not used as a connecting piece and therefore do not need to be perforated. A structure of the wire-threading clamping groove 1122 that can be penetrated through impact is used, so that dust-proof and waterproof performance can be effectively improved, that is, IP degree is improved. Strength of the wire-threading clamping groove 1122 that can be penetrated through impact is much lower than strength of the surrounding aluminium-made heat dissipation frame 11, the wire-threading clamping groove 1122 can be penetrated by appropriate impact, the penetrated clamping groove 1122 becomes the wire-threading through-hole 1121, and clamping groove 1122 can be used after penetration by a consumer when the consumer needs to use multiple LED modules for jointing, thereby having a proper structure and being convenient for use.

Connecting holes 122 are separately provided at two sides of the electrical interface 121 on the connection assembly part 12, the connecting hole 122 is used for assembling a connecting piece, such as assembling a mounting connecting plate, a bolt passes through the mounting connecting plate to be fixed in the connecting hole 122, and the mounting connecting plate is used for installation and fixing of the whole LED module.

The lens mask 6 is fixed on the aluminium-made heat dissipation frame 11, and a sealed waterproof ring 5 is disposed between the lens mask 6 and the aluminium-made heat dissipation frame 11. A shape of the lens mask 6 is a square that matches to the bottom surface of the aluminium-made heat dissipation frame 11, a middle part 61 of the lens mask protrudes downward relative to an edge to form a cavity, the edge of the lens mask 6 is fixed at an edge of a bottom part of the aluminium-made heat dissipation frame 11 by using a screw 66. Specifically, an edge of a bottom part of the lens mask 6 is provided with a plurality of mounting bases 62 that are arranged regularly and protrude downward, the mounting bases 62 are integrally connected to edge of the lens mask 6, and the screw 66 passes through the mounting base 62 to be fixed on the aluminium-made heat dissipation frame 11. The lens mask 6 needs to be removed when the LED 3 or the lens 4 is adjusted, and therefore a fixing manner of the screw 66 is most appropriate. In order to ensure firmness of installation, a structure of the mounting base 62 is used to join fixing of the screw 66, especially when the user needs to adjust the number of the heat dissipation plates 13 so as to adjust heat dissipation performance, the fixing manner of the screw 66 is most convenient for disassembly and assembly. A groove 65 for holding the sealed waterproof ring is provided at a joint on the lens mask 6 between the aluminium-made heat dissipation frame 11, the sealed waterproof ring 5 is fastened in the groove 65, and a location of the sealed waterproof ring 5 is at an inner side of the screw 66, which can better achieve an effect of sealed waterproof without water infiltration. All edges of 4 broadsides of the lens mask 6 are regularly provided with airflow notches 63; the number, shape and location of airflow notches on 4 broadsides are the same, and when two LED modules are jointed, two airflow notches 63 of corresponding locations and shapes are connected to form convection space. The convection space between two lens masks 6 when modules are connected is used for air convection, an edge of each broadside is provided with at least 2 airflow notches, and in this way, there are at least 2 pieces of local convection space at a connection position of the LED modules, which is more effective for a ceiling lamp or a product having an enclosed housing.

The lens 4 is mounted on the lens mask 6 in an enclosed manner. The lens mask 6 is provided with 12 lens mounting holes 64, 12 lens 4 are mounted on the lens mounting holes 64 in an enclosed and pressing manner, the 12 lens 4 are arranged into 4 arc-shaped lens strips of a same length, the four arc-shaped lens strips are connected end to end, and each arc-shaped lens strip is formed by arrangement of 5 lens. The number and arrangement locations of LEDs 3 on the PCB 2 match to the lens 4, that is, an LED 3 is provided right above each lens 4, and 12 LEDs 3 are arranged into 4 arc-shaped LED lighting strips of a same length, and each arc-shaped LED lighting strip is formed by arrangement of 5 LEDs 3. The foregoing 12 LEDs 3 are all low-voltage direct current LEDs. To achieve unification of arrangement layouts of different types of LEDs, in the LED module of this patent, a form of 12 low-voltage direct current LEDs is designed into 4 arc-shaped LED lighting strips, so that 4 high-voltage LEDs within a same distance arranged uniformly may be used to replace the foregoing low-voltage direct current LEDs, that is, on the basis of an arrangement layout of low-voltage LEDs that is applied widely in the current market, it is considered that a connecting wire may be added to removed to change an arrangement relationship of LEDs, so that a layout suitable for working of high-voltage direct current LEDs is implemented. When high-voltage direct current LEDs need to be used in change, 4 LEDs are enough. The 4 LEDs are used at equal positions, and lines are connected by using a pin wire or a wire. For example, each module uses a 48 V/DC power supply to drive twelve 3 V low-voltage direct current LEDs of power being 1 W, an arrangement manner is 12 strings, and when 54 V high-voltage LEDs of power being 3 W each are used in change, and an alternating current of 220 V or a direct current of 220 V is used to drive, then the number of LEDs of each module is 4, and the 4 LEDs need to be arranged into a string, and positions of the LEDs also need to be placed appropriately; otherwise, the layout appearance and illumination uniformity are affected.

Under different voltage and different power grades, requirements for a width and spacing of a copper foil wire are different. When the power is small, because a charge-carrying capacity is small, the copper foil wire may be relatively thin; when the voltage is low, because a voltage difference is small, the wire spacing may also be small. To achieve compatibility of a same PCB for different voltage and different power, in the LED module in this patent, the width and spacing of the copper foil wire are designed specifically, a current-carrying capacity of the copper foil wire is related to a thickness of copper foil, a width of a wire and a working environment, and a creepage distance is related to a spacing of the wire and a dielectric constant of a material. For a common PCB having a copper foil thickness being 1 ounce, and the working temperature is 20 degree and a width of the copper foil wire is 0.254 mm, a current about 1.2 A can be withstood. To facilitate series and parallel connection of multiple modules so as to implement current withstanding of power of lamp higher than 120 W, in the LED module of this patent, a thinnest width of the copper foil wire connected to a power supply is between 2.5 mm to 10 mm, to ensure that a current about 4.5 A can be bore. For the creepage distance, for a common circuit, the requirement is not high, as long as the creepage distance is greater than 0.2 mm. In this patent, the creepage distance is 0.8 mm, and enough allowance is remained, which effectively avoids current overload caused by parallel combination of modules, and effectively avoids a creepage risk caused by load voltage rise due to use of alternating LEDs and high-voltage direct current LEDs. The foregoing special design achieves an idea of compatibility when different types of LEDs use a same PCB and use a same group of lens covers, which facilitates manufacturing and reduces costs of materials.

The IP treatment has been performed on the electrical interface 121. The IP treatment refers to treatment that conforms to the IP degree. There are multiple IP treatment manners for the electrical interface 121. For example, conventionally, a sealed waterproof washer is added around the electrical connector, or a sealing cover is disposed outside the electrical interface 121 to seal the electrical interface 121, and the structure of the wire-threading clamping groove 1122 that can be penetrated through impact also belongs to the IP treatment manners for the electrical interface 121, an IP degree of the LED module that uses the foregoing technical solutions reaches at least 66. When the electrical interface 121 is not used for jointing, an opening of the electrical interface 121 is usually sealed by a sealing cover, and especially, the unused electrical interface 121 corresponding to the wire-threading through-hole 1121 needs to be sealed by using a sealing cover. There are many types of electrical connectors, and a wiring terminal is commonly used.

The foregoing embodiments are only preferred implementation manners of this patent, for example, the number of the connection assembly parts may be adjusted, may be 2, 3, 5, or 6, the number of the wire-threading positions and the power-on interfaces 21 needs to match the number of the connection assembly parts 12, and besides, the shape of the aluminium-made heat dissipation frame 11 may also be changed, for example, is a semi-circle or a regular polygon.

In real use, in the foregoing embodiments, a square section of the aluminium-made heat dissipation frame 11 and 4 connection assembly parts achieve a best using effect. In this structure, extension edges may be retained all around, combination change of different usages and different power grades is implemented, and locations of the airflow notches 63 in all surfaces are unified, so that jointing of modules may be performed by using any surface, which is most convenient for use; the connection assembly part 12 not at a joint position may be used for fixing of the modules, and combination of functions of jointing and fixing is most perfect and is most convenient for use, thereby being the best implement manner of this patent.

The 4 wire-threading positions may all be the wire-threading through-holes 1121, or may partly be the wire-threading through-holes 1121. All parts of the LED module in the foregoing embodiments have good dust-proof and waterproof performance and a high IP degree, and totally conforms to conditions of outdoor use, that is, can be directly used in outdoor without adding a rain shield casing. Due to the connection assembly part 12 at an edge of a broadside of the bottom surface of the aluminium-made heat dissipation frame 11 and the power-on interface 21, on the PCB 2, that matches to the connection assembly part 12, extension edges are retained around the LED module, and combination change of different usages and different power grades is implemented, so as to facilitate multi-purpose requirements of consumers, that is, multiple LED modules may be conveniently jointed and combined, and the connection assembly part not at a joint position may be used for installation and fixing of the LED module. When the LED module is used in single, a switch and brightness of the LED 3 are controlled by an IC chip on the PCB 2, light emitted from the LED 3 comes out through the lens 4, and heat generated by the LED 3 during working is radiated by the heat dissipation component. The IC chip 22 on the PCB 2 controls a working current of the LED and a quantity of working heat of the LED by using a pulse width modulation technology, performs regulated voltage and constant current adjustment by changing a duty cycle, that is, regulated voltage and a constant current are achieved by using the pulse width modulation (PWM) technology. The IC chip monitors a working temperature of the LED, thereby implementing a function of temperature protection. A current is reduced automatically to ensure stability of working performance of the LED when an interior temperature exceeds a set index, and stable voltage is implemented by changing the duty cycle, so that voltage fluctuation is effectively reduced and a constant current drive effect of the LED is improved. Specifically, an over-temperature protection device is integrated inside the IC chip, when a temperature sensor senses that the temperature exceeds a certain value, a connecting triode is conducted, and a working current is reduced by shunting, thereby implementing a temperature-reducing function. The PWM technology is an analogue control manner that adjusts a bias of a transistor base or a metal oxide semiconductor (MOS) grid according to load change to implement change of a conducting time of the transistor or the MOS, and this manner can enable the output voltage of a power supply to always maintain constant when the working condition changes. When two or multiple LED modules are jointed, adjacent LED modules are connected at respective connection assembly parts 12 by using a connecting piece, and the adjacent LED modules are connected by using the connecting piece and the electrical interface, so that free combination of modules is achieved.

What is claimed is:

1. An LED module, comprising an LED, a PCB, a lens, a lens mask and a heat dissipation component, wherein the LED is mounted on the PCB, the PCB is fixed on the heat dissipation component, the lens is mounted on the lens mask in an enclosed manner, the lens mask is fixed on the heat dissipation component, and a sealed waterproof ring is disposed between the lens mask and the heat dissipation component; characterized in that the heat dissipation component comprises an aluminium-made heat dissipation frame, a heat-conducting fin, a connection assembly part and a plurality of heat dissipation plates, the aluminium-made heat dissipation frame is provided with a plurality of heat dissipation plate mounting holes that are arranged in parallel, the heat dissipation plates are amounted in the heat dissipation plate mounting holes on the aluminium-made heat dissipation frame in an insertion mode, the PCB is fixed on a bottom surface of the aluminium-made heat dissipation frame, and the heat-conducting fin is located between the PCB and the heat dissipation plates on the aluminium-made heat dissipation frame; the LED is integrally connected to the PCB, and an IC chip on the PCB controls a working current and a quantity of working heat of the LED through pulse width modulation, and performs regulated voltage and constant current adjustment by changing a duty cycle; the connection assembly part is fixed at an edge of an upper part of the aluminium-made heat dissipation frame, each connection assembly part is provided with an electrical interface on which ingress protection (IP) treatment has been performed, the PCB is provided with a power-on interface that matches to the electrical interface on the connection assembly part and can connect to the electrical interface, a wire-threading position is provided on the aluminium-made heat dissipation frame, and a location of the wire-threading position is between a corresponding electrical interface and a corresponding power-on interface; and there is a plurality of connection assembly parts, the number of wire-threading positions and power-on interfaces matches to the number of connection assembly parts, at least one wire-threading position is a wire-threading through-hole, the rest wire-threading positions are wire-threading clamping grooves that can be penetrated through impact.

2. The LED module according to claim 1, wherein a section of the aluminium-made heat dissipation frame is rectangular, an edge of each side of the upper part of the aluminium-made heat dissipation frame is provided with a connection assembly part, there are four connection assembly parts, a location of each connection assembly part is at a middle position of each side, and the connection assembly parts are integrally connected to the aluminium-made heat dissipation frame; and the aluminium-made heat dissipation frame is provided with four wire-threading positions, the PCB is provided with four power-on interfaces, whose locations match to the electrical interfaces on the connection assembly parts, that can connect to the electrical interfaces.

3. The LED module according to claim 2, wherein a section of the aluminium-made heat dissipation frame is square.

4. The LED module according to claim 2, wherein the PCB is provided with an LED brightness adjusting module, the PCB is provided with four power-on interfaces, and each power-on interface can control an LED switch and adjust LED brightness; and a shape of the lens mask is a rectangle that matches to the bottom surface of the aluminium-made heat dissipation frame, a middle part of the lens mask protrudes downward relative to an edge of the lens mask to form a cavity, and the edge of the lens mask is fixed at an edge of a bottom part of a rectangular fixing panel by using a screw.

5. The LED module according to claim 4, wherein all edges of four broadsides of the lens mask are regularly provided with airflow notches; an edge of a bottom part of the lens mask is provided with a plurality of mounting bases that are arranged regularly and protrude downward, the mounting bases are integrally connected to the lens mask, and the screw passes through the mounting base to be fixed on the aluminium-made heat dissipation frame; a groove for holding the sealed waterproof ring is provided at a joint on the lens mask between the aluminium-made heat dissipation frame, the sealed waterproof ring is fastened in the groove, and a location of the sealed waterproof ring is at an inner side of the screw; the lens mask is provided with 12 lens mounting holes, 12 lens are mounted on the lens mounting holes in an enclosed and pressing manner, the 12 lens are arranged into four arc-shaped lens strips of a same length, and each arc-shaped lens strip is formed by arrangement of five lens; and the number and arrangement locations of LEDs on the PCB match to the lens, that is, an LED is provided right above each lens, and 12 LEDs are arranged into four arc-shaped LED lighting strips of a same length.

6. The LED module according to claim 5, wherein the number, shape and location of airflow notches of four broadsides are the same, and an edge of each broadside is provided with at least two airflow notches; and connecting holes are separately provided at two sides of the electrical interface on the connection assembly part, a mounting connecting plate is provided on the connection assembly part, and a bolt passes through the mounting connecting plate to be fixed in the connecting hole.

7. The LED module according to claim 1, wherein an upper surface of the aluminium-made heat dissipation frame is provided with two fixed heat dissipation plates, and bottom parts of the two fixed heat dissipation plates are integrally connected to the upper surface of the aluminium-made heat dissipation frame; and a section of the heat dissipation plate is of an L shape, the heat dissipation plate is integrally formed by a long plate and a short plate, the long plate passes through the heat dissipation plate mounting hole on the aluminium-made heat dissipation frame, and the short plate is fastened on the aluminium-made heat dissipation frame below the heat dissipation plate mounting hole.

8. The LED module according to claim 7, wherein an electrical connector is disposed in at least one electrical interface right above the wire-threading through-hole.

* * * * *